United States Patent [19]

Christie

[11] Patent Number: 4,761,817

[45] Date of Patent: Aug. 2, 1988

[54] DIAPHRAGM STRUCTURE FOR A TRANSDUCER

[75] Inventor: Cary L. Christie, Canoga, Calif.

[73] Assignee: Harman International Industries, Incorporated, Northridge, Calif.

[21] Appl. No.: 823,068

[22] Filed: Jan. 27, 1986

[51] Int. Cl.[4] ..... H04R 9/00; H04R 7/02; H04R 7/24

[52] U.S. Cl. ..... 381/194; 181/157; 181/167; 381/184; 381/204

[58] Field of Search ..... 381/194, 202, 204, 184, 381/192, 197; 181/170, 171, 157, 167

[56] References Cited

U.S. PATENT DOCUMENTS

| | | | |
|---|---|---|---|
| 1,699,786 | 1/1929 | Goldsborough | 181/173 |
| 1,734,624 | 11/1929 | Harrison | 181/163 |
| 1,743,767 | 1/1930 | Focht | 181/164 |
| 1,775,294 | 9/1930 | Poroma | 181/164 |
| 1,798,688 | 3/1931 | LaRue | 181/164 |
| 1,826,226 | 10/1931 | Searle | 181/165 |
| 1,844,487 | 2/1932 | Tyrrell | 181/164 |
| 1,870,417 | 8/1932 | Mallina | 181/170 |
| 1,917,013 | 7/1933 | Bostwick | 181/164 |
| 1,926,187 | 3/1933 | Young | 381/202 |
| 2,549,139 | 4/1951 | Stevens | 181/165 |
| 2,923,371 | 2/1960 | Otto | 181/161 |
| 3,111,187 | 11/1963 | Barlow | 181/168 |
| 3,364,315 | 1/1968 | Gorike | 381/203 |
| 3,464,514 | 9/1969 | Mochida et al. | 381/204 |
| 3,596,733 | 8/1971 | Bertagni | 381/202 |
| 3,983,337 | 9/1976 | Babb | 381/194 |
| 4,112,168 | 9/1978 | Schafft | 381/202 |
| 4,132,872 | 1/1979 | Inoue | 181/165 |
| 4,135,601 | 1/1979 | Tsukagoshi et al. | 381/202 |
| 4,139,733 | 2/1979 | Falkenberg | 181/170 |
| 4,198,550 | 4/1980 | Matsuda et al. | 381/202 |
| 4,297,537 | 10/1981 | Babb | 381/194 |
| 4,300,655 | 11/1981 | Sakamoto et al. | 381/202 |
| 4,321,434 | 3/1982 | Irie | 181/172 |
| 4,410,768 | 10/1983 | Nakamura et al. | 381/203 |
| 4,484,383 | 11/1984 | Takewa et al. | 181/156 |
| 4,563,623 | 8/1985 | Larson | 381/202 |

*Primary Examiner*—Jin F. Ng
*Assistant Examiner*—Danita R. Byrd
*Attorney, Agent, or Firm*—Barnes & Thornburg

[57] ABSTRACT

A diaphragm for an acoustical transducer comprises a support and a separate cover for the support. The support is constructed from a relatively more rigid material having the desired physical characteristics of mass and stiffness for the transducer. The cover comprises a light weight, relatively less rigid, and pliable sheet of material. The cover is attached to the support, illustratively by an adhesive, to form the diaphragm.

11 Claims, 2 Drawing Sheets

DIAPHRAGM STRUCTURE FOR A TRANSDUCER

BACKGROUND OF THE INVENTION

1. Field of Invention

This invention relates to transducers and particularly to a diaphragm structure for an acoustical transducer.

2. Description of the Related Art

Many types of diaphragm structures for acoustical transducers are known. Illustrative, but not necessarily representative, diaphragm structures are illustrated and described in the following U.S. Pat. Nos.: 3,364,315; 4,132,872; 1,699,786; 1,743,767; 1,917,013; 1,798,688; 1,775,294; 1,870,417; 2,923,371; 1,844,487; 1,734,624; 2,549,139; 4,139,733; 4,321,434.

The design criteria for acoustical transducer diaphragms typically include high diaphragm stiffness and light diaphragm weight. High diaphragm stiffness aids high fidelity reproduction of the program material. Light diaphragm weight results in acceptable internal energy loss and aids in attaining high efficiency. These considerations have resulted in numerous diaphragm structures and diaphragm construction techniques. Illustrative of these various diaphragm structures and construction techniques are those in the above-identified patents and those illustrated in U.S. Pat. Nos. 4,484,383 and 1,826,226.

SUMMARY OF THE INVENTION

It is an object of the present invention to provide an improved diaphragm and improved diaphragm construction technique in which the diaphragm is separated into at least two components, one, an extremely light weight air movement-component which accomplishes the objective of light weight for acceptable internal loss and high efficiency, and the other a light weight but considerably more rigid support component. The light weight of the support component aids in obtaining the reduced internal loss and high efficiency, while the rigidity of the second component aids in fulfilling the criterion of acceptable stiffness for obtaining high fidelity.

According to the invention, a diaphragm for an acoustical transducer comprises a support and a separate cover for the support. The support is constructed from a relatively more rigid material having the desired physical characteristics of mass and stiffness for the transducer. The cover comprises a light weight and pliable sheet. Means are provided for mounting the cover on the support to form the diaphragm.

According to another aspect of the invention, an acoustical transducer comprises a magnetic element having a center pole piece and an annular pole piece joined in a magnetic circuit and defining between them an air gap, a voice coil sized to fit the gap, and a diaphragm including a support and a cover for the support. The support has a region for joining to the voice coil. Means are providing for attaching the cover to the support to form the diaphragm. The support is constructed from a relatively more rigid material having the desired physical characteristics of mass and stiffness for the transducer. The cover comprises a light weight and pliable sheet.

Illustratively, the support comprises a generally central region and a plurality of ribs radiating from the generally central region. Means are provided for mounting the voice coil form adjacent the generally central region. Alternatively, the support comprises a grid, and means are provided for mounting the voice coil from the grid.

Additionally, according to an illustrative embodiment, the support is constructed from a material from the group consisting of carbon-filled resins, glass-filled resins, boron-filled resins and titanium.

Further according to an illustrative embodiment, the cover is constructed from a material from the group consisting of paper, polyester films and films of vinyl chloride polymers or vinylidene choloride polymer or copolymers of vinyl chloride and vinylidene chloride.

BRIEF DESCRIPTION OF THE DRAWINGS

The invention may best be understood by referring to the following description and accompanying drawings which illustrate the invention. In the drawings.

DETAILED DESCRIPTION OF ILLUSTRATIVE EMBODIMENTS

Figure 1:
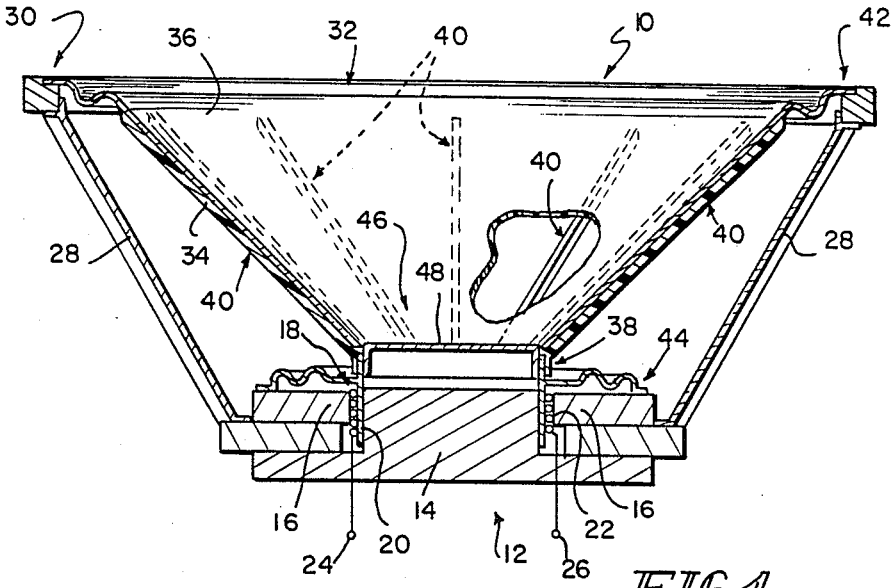
FIG. 1 is a sectional side elevational view of a device constructed according to the present invention.
Figure 2:
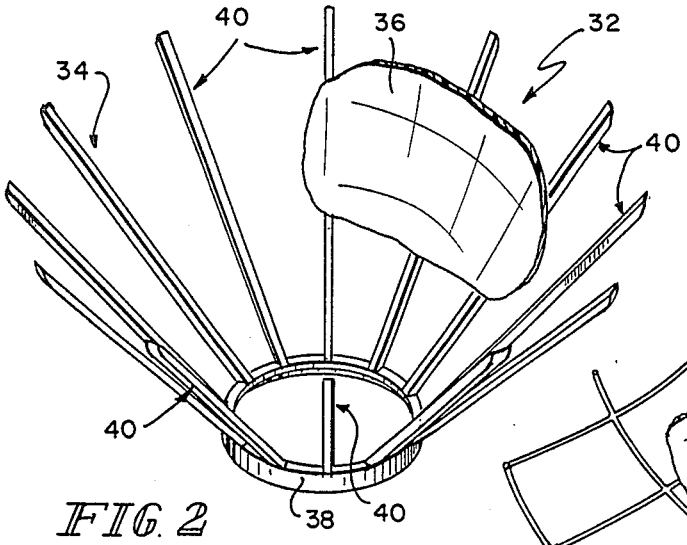
FIG. 2 is a fragmentary perspective view of a detail of the device of FIG. 1.

Referring to FIGS. 1–2, an acoustical transducer, or speaker, 10 comprises a motor magnet assembly 12 providing a center pole piece 14 and an annular pole piece 16 defining between them an air gap 18 having a configuration to accept a coil form 20 on which is mounted a motor armature or voice coil 22. The terminals 24, 26, illustrated schematically, of voice coil 22 are the terminals across which a voltage representative of the program material is impressed to drive the voice coil 22 and the diaphragm attached to the coil form 20 back and forth to reproduce the program material. A supporting framework 28 is mounted upon, and extends away from, the magnet assembly 12 and defines, at its remote extent, a circular opening 30.

A diaphragm 32 is mounted in the opening 30. The diaphragm 32 comprises a support 34 and a cover 36 (illustrated fragmentarily in FIG. 2) which is substantially permanently mounted to the support 34. The support 34 includes a central region 38 and a plurality of ribs 40 which radiate outwardly from the central region 38. The illustrated support 34 is constructed from a graphite-filled resin which provides extreme light weight, while exhibiting sufficient rigidity to insure high fidelity sound reproduction. To help achieve that light weight in the diaphragm 32 to minimize internal loss and achieve high efficiency, the cover 36 is formed from a thin layer of saran, a vinyl chloride-vinylidine chloride copolymer. The cover 36 may be attached to the support 34 by applying a suitable adhesive to each rib 40, placing the cover 36 on the support 34 and curing the adhesive while the cover 36 is in contact with the ribs 40. An annular compliance ring 42 of rubber-impregnated cloth is attached at its outer periphery to the inner periphery of opening 30. The inner periphery of compliance ring 42 is attached by a suitable adhesive to the diaphragm 32. The voice coil form 20 is attached by a suitable adhesive to the central region 38 of support 34. A centering spider 44 is attached at its inner periphery to the coil form 20 and at its outer periphery to the magnet assembly 12 to aid in supporting diaphragm 32 in its rest position and to assist in centering the coil form 20 and voice coil 22 in the air gap 18. Centering spider 44 also protects the air gap 18 against dust and other contaminants which might otherwise enter the space between coil form 20 and annular pole piece 16. The central region 46 of diaphragm 32, within the central region 38 of support 34, is covered by a dust cap 48 to prevent the entry of dust or other contaminants into the space between coil form 20 and center pole piece 14.

Figure 3:
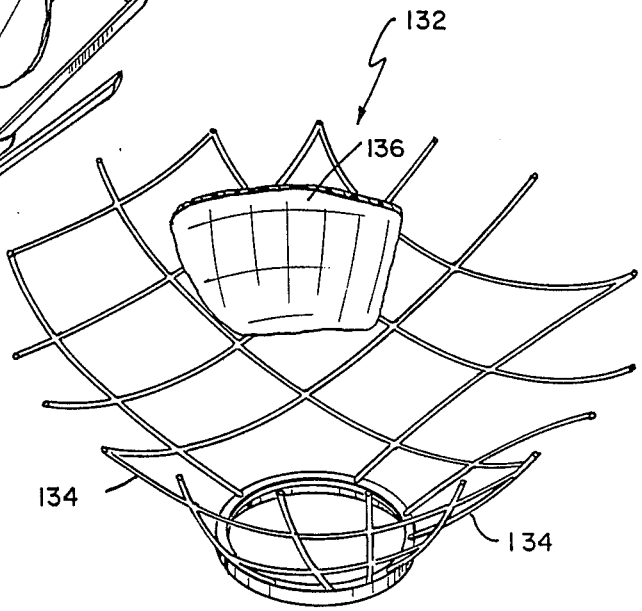
FIG. 3 is a fragmentary perspective view of another construction of the detail of FIG. 2.

In the embodiment of FIG. 3, a diaphragm 132 includes a grid-shaped support 134 and a cover 136, only a portion of which is illustrated. Again, the support can be constructed from any material which provides the light weight and rigidity which assists to fulfill the fidelity requirements of a particular transducer. The cover can be constructed from any material which provides the light weight which assists to fulfill the efficiency requirements of a particular transducer.

Figure 4:
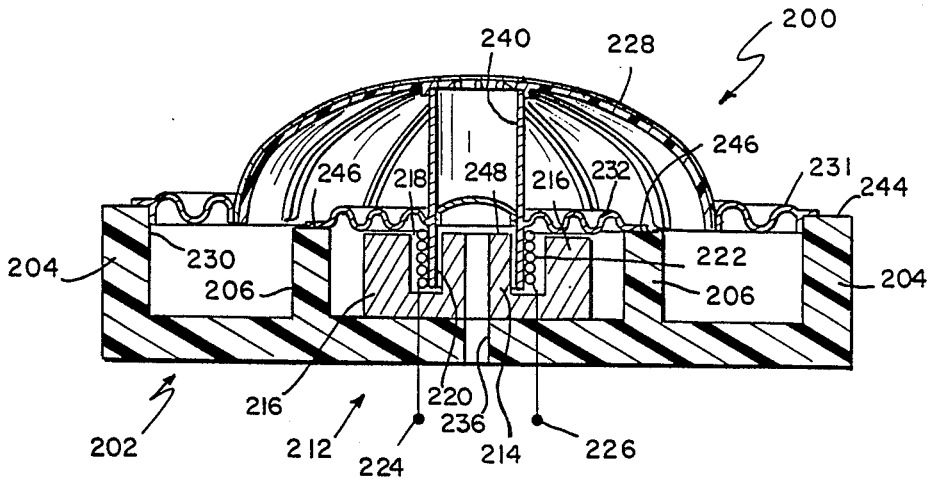
FIG. 4 is a sectional side elevational view of another device constructed according to the present invention.

In the embodiment of FIG. 4, a dome speaker 200 includes a base support member 202. Illustratively, dome speaker 200 is round so base support member 202 will also be round. However, if dome speaker 200 is constructed otherwise, such as in the form of an ellipse, support member 202 will have that form. Illustratively, base support member 202 is constructed from a light weight, rigid material such as a filled or unfilled resin.

Base support member 202 includes, around its outer perimeter, an upwardly extending outer support wall 204. Base support member 202 also includes, spaced inwardly from outer support wall 204, an upwardly extending inner support wall 206. Inner support wall 206 extends around the center of base member 202 in spaced relation to the center and is generally coaxial with outer support wall 204.

Base support member 202 supports a motor magnet assembly 212 which has a center pole piece 214 and an annular pole piece 216 defining between them an air gap 218 having a configuration to accept a coil form 220. A motor armature or voice coil 222 is mounted on coil form 220 to lie within the air gap 218. Terminals 224, 226 of voice coil 222, illustrated schematically, are the terminals across which a voltage representative of the program material is impressed to drive the voice coil 222, thus driving coil form 220 and a dome-shaped diaphragm 228 attached to the coil form 220 back and forth to reproduce the program material.

Outer support wall 204 of base support member 202 defines a circular opening 230. Dome-shaped diaphragm 228 is mounted in the opening 230. Dome-shaped diaphragm 228 is formed in the manner discussed above by covering the top of a somewhat mushroom- or-umbrella-shaped, rigid, lightweight support framework 229 of, for example, graphite-filled resin with a thin layer 233 of material such as saran. The thin layer of material is attached to the support framework by a suitable adhesive.

An annular compliance ring 231 of rubber-impregnated cloth is attached at its outer periphery to the inner periphery of opening 230 at the upper end 244 of outer support wall 204. Illustratively, the outer periphery of compliance ring 231 is attached to the upper end 244 of support wall 204 with a suitable adhesive. The inner periphery of compliance ring 231 is also attached by a suitable adhesive to the outer periphery of the dome-shaped diaphragm 228.

Voice coil form 220 is attached at its end 240 to the center of dome-shaped diaphragm 228 with a suitable adhesive. A centering spider 232 is attached at its inner periphery to the coil form 220 and at its outer periphery to an upper end 246 of inner support wall 206 to assist in centering the coil form 220 and voice coil 222 in the air gap 218. A vent 236 extends through the center of base support member 202 and center pole piece 214. Vent 236 facilitates the movement of the air displaced as coil form 220 moves to drive diaphragm 228.

The constructions illustrated permit extreme flexibility in the manufacture of acoustical transducers. Specifically, a support having the desired mass and stiffness can be mated to a cover having a desired mass to achieve the requisite stiffness for a particular fidelity, as well as to maintain a particular weight which results in an acceptable internal loss and an acceptable efficiency.

Other designs can be employed in the implementation of the invention. For example, the transducer may be of some type other than a circular type. That is, the opening 30 (FIG. 1) or 230 (FIG. 4) may be elliptical or of some other shape instead of circular. The support 34, 134, 229 can be constructed from some other sufficiently light-weight, rigid material. Examples are other filled resins, such as glass-filled resin, boron-filled resins, light metals, such as titanium, and other materials. Other materials can also be used for the cover 36, 136, 233. Examples are other thin, lightweight polymer films, such as polyester films, or light-weight papers.

What is claimed is:

1. A diaphragm for an acoustical transducer comprising a support and a separate cover for the support, the support constructed from a rigid material, the support including a central region and rib means attached to, and projecting away from, the central region, the rib means being oriented with respect to each other by their attachment to the central region, the orientations of the rib means with respect to each other being maintained by the central region of the support, the cover comprising a light weight, relatively less rigid, and pliable sheet, and means for mounting the cover on the support to form the diaphragm.

2. The diaphragm of claim 1 wherein the rib means comprises a plurality of ribs radiating from the central region.

3. The diaphragm of claim 1 wherein the rib means comprises a grid.

4. The diaphragm of claim 1 wherein the support is constructed from a material from the group consisting of carbon-filled resins, glass-filled resins, boron-filled resins and titanium.

5. The diaphragm of claim 1 wherein the cover is constructed from a material from the group consisting of paper, polyester films, films of vinyl chloride polymers, films of vinylidene chloride polymers, and films of copolymers containing both vinyl chloride and vinylidene chloride.

6. An acoustical transducer comprising a magnet having a center pole piece and an annular pole piece joined in a magnetic circuit and defining between them an air gap, a voice coil sized to fit the air gap, and a diaphragm including a support and a cover for the support, the support having a perimeter for coupling to the magnet and a region for joining to the voice coil, and means for attaching the cover to the support to form the diaphragm, the support constructed from a rigid material and the cover constructed from a light weight, relatively less rigid and more pliable sheet material, the support including a central region and rib means attached to, and projecting away from, the central region, the rib means being oriented with respect to each other by their attachment to the central region, the orientations of the rib means with respect to each other being maintained by the central region of the support.

7. The transducer of claim 6 wherein the cover is constructed from a material from the group consisting of paper, polyester films, films of vinyl chloride polymers, films of vinylidene chloride polymers, and films of copolymers containing both vinyl chloride and vinylidene chloride.

8. The transducer of claim 7 wherein the rib means comprises a plurality of ribs radiating from the central region.

9. The transducer of claim 8 wherein the support is constructed from a material from the group consisting of carbon-filled resins, glass-filled resins, boron-filled resins and titanium.

10. The transducer of claim 7 wherein the rib means comprises a grid.

11. The transducer of claim 10 wherein the support is constructed from a material from the group consisting of carbon-filled resins, glass-filled resins, boron-filled resins and titanium.

* * * * *